US009003683B1

(12) United States Patent
Feliciano et al.

(10) Patent No.: US 9,003,683 B1
(45) Date of Patent: Apr. 14, 2015

(54) FOLDING SIGN

(71) Applicants: Victor Juan Feliciano, Chino Hills, CA (US); Sondra A. Aragon, Chino Hills, CA (US)

(72) Inventors: Victor Juan Feliciano, Chino Hills, CA (US); Sondra A. Aragon, Chino Hills, CA (US)

( * ) Notice: Subject to any disclaimer, the term of this patent is extended or adjusted under 35 U.S.C. 154(b) by 0 days.

(21) Appl. No.: 14/473,024

(22) Filed: Aug. 29, 2014

Related U.S. Application Data

(60) Provisional application No. 61/873,128, filed on Sep. 3, 2013.

(51) Int. Cl.
*G09F 15/00* (2006.01)
*G09F 7/00* (2006.01)

(52) U.S. Cl.
CPC ..... *G09F 15/0062* (2013.01); *G09F 7/00* (2013.01); *G09F 15/0025* (2013.01)

(58) Field of Classification Search
CPC ..... G09F 15/0062; G09F 15/0025
See application file for complete search history.

(56) References Cited

U.S. PATENT DOCUMENTS

| | | | | | |
|---|---|---|---|---|---|
| 541,672 | A * | 6/1895 | Pappin | 40/610 |
| 1,227,989 | A * | 5/1917 | Axtell | 40/610 |
| 2,965,159 | A * | 12/1960 | Fridolph | 248/465 |
| 3,595,509 | A * | 7/1971 | Gilmoure et al. | 248/175 |
| 5,230,196 | A * | 7/1993 | Zeigler | 52/646 |
| 5,371,964 | A | 12/1994 | Kubacki et al. | |
| 5,551,178 | A * | 9/1996 | Foley et al. | 40/610 |
| 5,794,640 | A * | 8/1998 | Jang | 135/131 |
| 6,244,011 | B1 * | 6/2001 | Esser | 52/646 |
| 6,606,809 | B2 | 8/2003 | Hillstrom et al. | |
| 8,122,629 | B2 | 2/2012 | Cowgill | |
| 2012/0204456 | A1 * | 8/2012 | Dobson et al. | 40/610 |

* cited by examiner

*Primary Examiner* — Gary Hoge
(74) *Attorney, Agent, or Firm* — Kirk A. Buhler; Buhler & Associates

(57) ABSTRACT

Improvements in a foldable sign are disclosed. The sign provide a foldable "A" frame floor sign that folds for easy storage. The folding sign generally includes An "A" frame. The "A" frame provides a stable platform with multiple cross members that support the sign from wind or uneven surfaces. The "A" frame folds in two dimensions to create a dense elongated collapsed structure. The storage is by folding the structure at the apex of the "A" frame and bringing the sides together. Because the sign is flexible, the sign can be folded or wrapped around the collapsed frame. In this dense elongated collapsed structure the folding sign can be placed in an elongated storage bag. While the sign is folded for storage and transportation, when the sign is expanded it essentially resembles traditional "A" frame structures with the same overall dimensions.

20 Claims, 5 Drawing Sheets

FOLDING SIGN

CROSS REFERENCE TO RELATED APPLICATION

This application claims the benefit of Provisional Application Ser. No. 61/873,128 filed Sep. 3, 2014 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in foldable signs. More particularly, the present invention relates generally to folding "a" frame floor signs and more specifically it relates to a folding sign for Provide a foldable "A" frame floor sign that folds for easy storage.

2. Description of Related Art Including Information Disclosed Under 37 CFR 1.97 and 1.98

The invention generally relates to a folding "a" frame floor sign which includes An "A" frame.

There has thus been outlined, rather broadly, some of the features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A number of patents and or publications have been made to address these issues. Exemplary examples of patents and or publication that try to address this/these problem(s) are identified and discussed below.

U.S. Pat. No. 5,371,964 issued on Dec. 13, 1994 to Ronald R. Kubacki et al., discloses a Display Sign with Collapsible Support Base. In this patent the base is essentially two hinged "U" tubes. The sign is elevated from the hinge area. While this patent is for a collapsible sign, just the base collapses and the sign portion is essentially a rigid piece that does not collapse or fold.

U.S. Pat. No. 6,606,809 issued on Aug. 19, 2003 to David U. Hillstrom et al., discloses a Fold-up Sign Panel Assembly. In this patent the sign is diamond shaped and extends with a vertical pole to a base support. The sign allows for visibility from only one direction because the back surface is the frame structure. Because the sign is large, the base is designed to move with heavy winds. This patent is not an "A" frame structure that allows the sign to collapse for storage in a bag.

U.S. Pat. No. 8,122,629 issued on Feb. 28, 2012 to John Cowgill and discloses a Collapsible Sign. The sign is constructed with four legs that fold out from a vertical pole. The vertical pole has a horizontal arm where a flexible and weighted sign can hang. This patent does not have a stable "A" frame base and the sign can move from the wind.

What is needed is a collapsible "A" frame structure that can support flexible signage on at least one side. The collapsible frame and sign can be folded and stored in a bag for easy storage and transportation. The collapsible and folding sign in this disclosure provides the solution.

BRIEF SUMMARY OF THE INVENTION

An object is to provide a folding sign for Provide a foldable "A" frame floor sign that folds for easy storage. The "A" frame provides a stable platform with multiple cross members that support the sign from wind or uneven surfaces. The "A" frame folds in two dimensions to create a dense elongated collapsed structure.

Another object is to provide a Folding Sign those stores easily. The storage is by folding the structure at the apex of the "A" frame and bringing the sides together. Because the sign is flexible, the sign can be folded or wrapped around the collapsed frame. In this dense elongated collapsed structure the folding sign can be placed in an elongated storage bag.

Another object is to provide a Folding Sign to take less room while stored. When the signs are being transported in a vehicle the vehicle can limit the number of signs based upon the storage space in the vehicle. Room that is used for signs decrease the storage space in a vehicle for other items.

Another object is to provide a Folding Sign that takes less room while being transported. The smaller storage size allows more signs to be stored in a smaller space to allow the user to transport more signs and therefore increase the number of signs that can be seen by perspective customers or clients.

Another object is to provide a Folding Sign that pulls out to a full size frame while being displayed. While the sign is folded for storage and transportation, when the sign is expanded it essentially resembles traditional "A" frame structures with the same overall dimensions.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
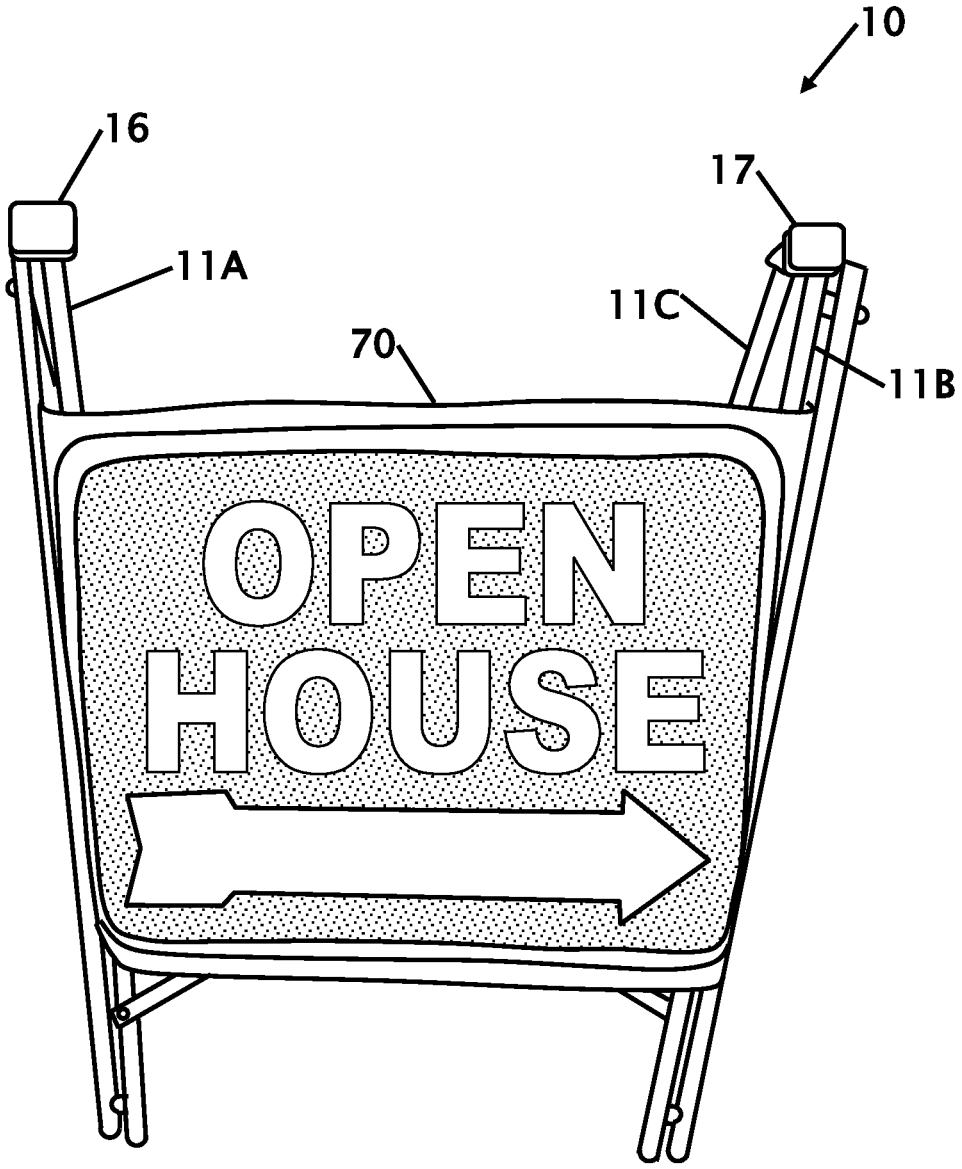
FIG. 1 is a front view of the foldable sign frame in the opened position also displaying an open house sign.
Figure 2:
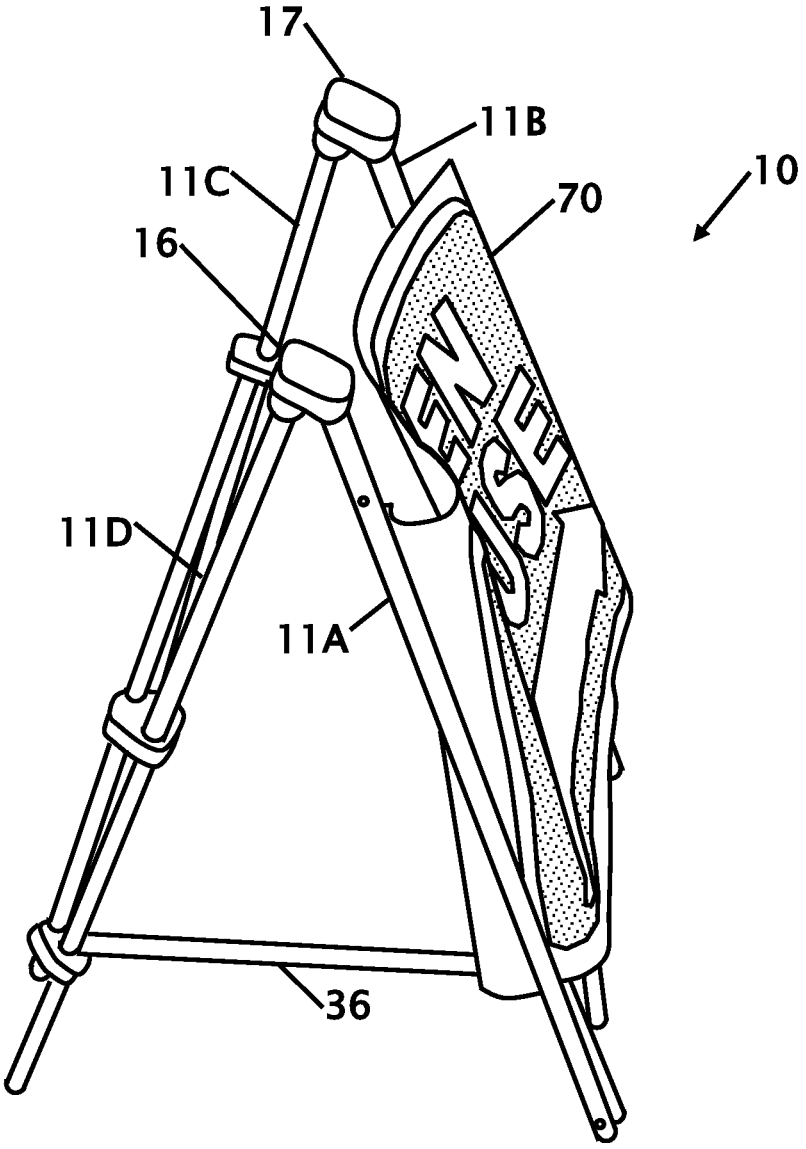
FIG. 2 is a side view of the foldable sign frame shown in an opened configuration displaying open house sign.

Turning now descriptively to the drawings, in which similar reference characters denote similar elements throughout the several views, the figures illustrate an "A" frame. FIG. 1 is a front view of the foldable sign frame 10 in the opened position also displaying an open house sign and FIG. 2 is a side view of the foldable sign frame 10 shown in an opened configuration displaying open house sign. In these figures an "OPEN HOUSE" flexible sign 70 is shown stretched across the front of the A frame. The top of each side of the A frame has a hinged caps 16 and 17 that allow the sides to hinge. The caps 16 and 17 further provide a limit to the amount that the posts 11A-11D can be opened. In FIG. 2 the locking arm 36 is shown that secures the sign in an open orientation.

Figure 3:
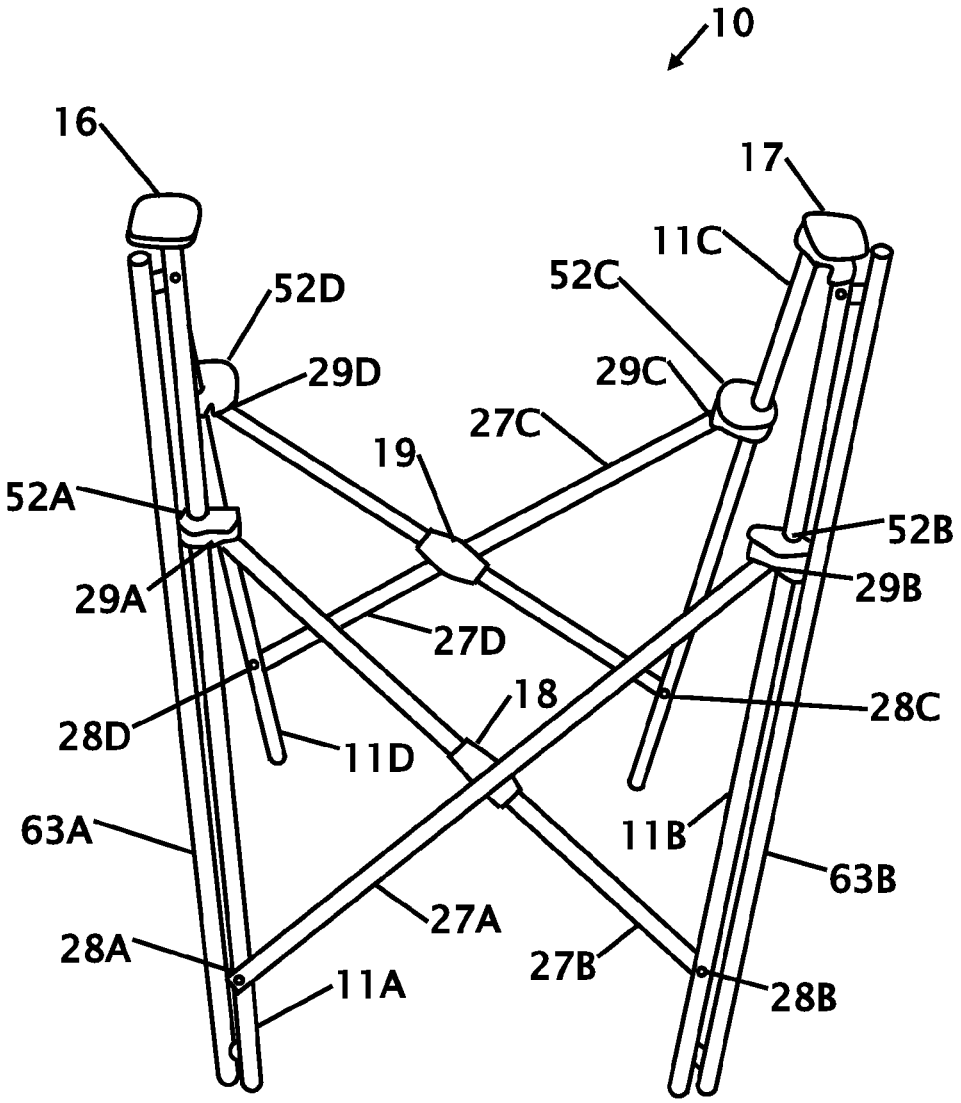
FIG. 3 is a front view of the foldable sign shown in a partially open configuration without a sign on frame.
Figure 4:
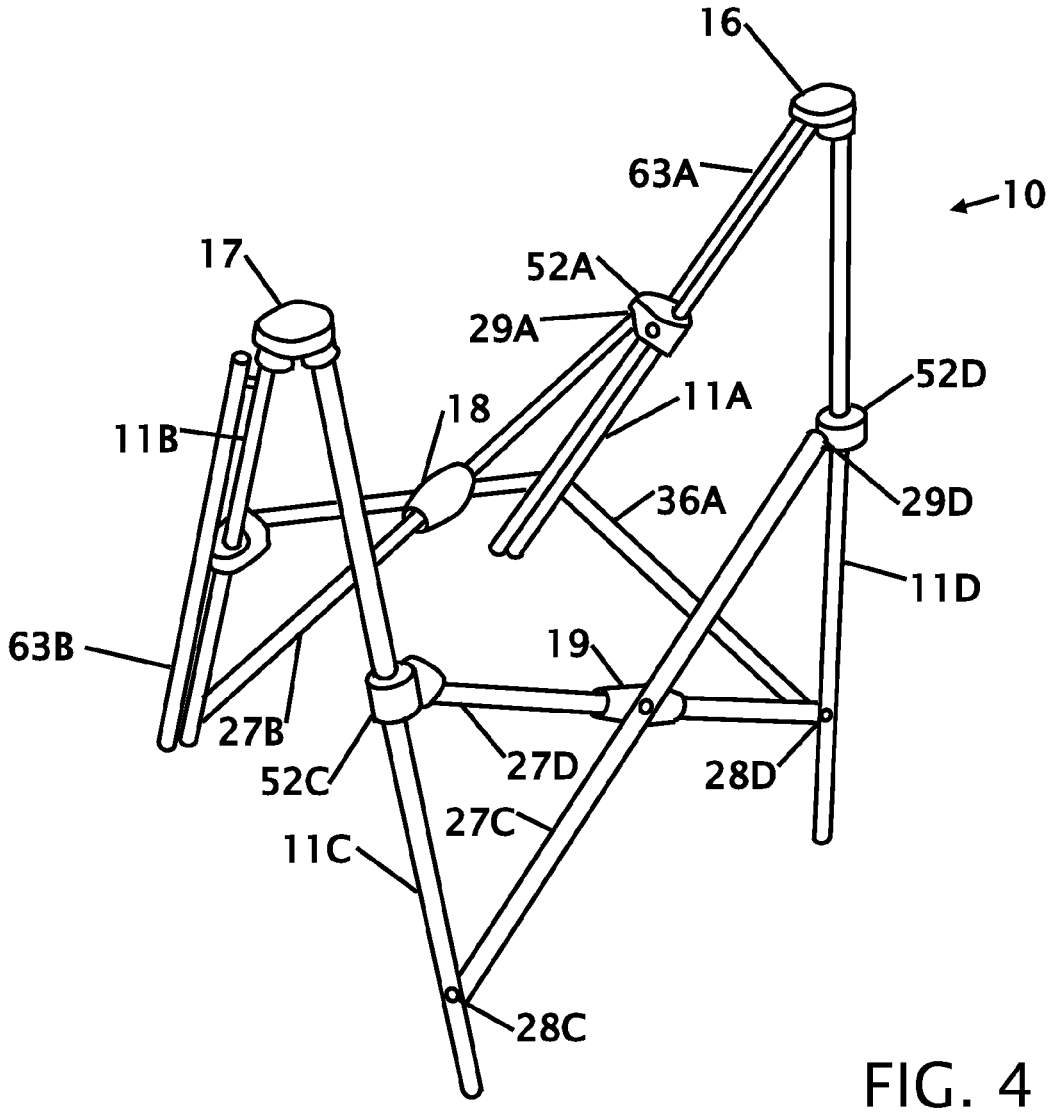
FIG. 4 is a side perspective view of the foldable sign showing the frame from the side and all of the parts.

FIG. 3 is a front view of the foldable sign shown in a partially open configuration without a sign on frame and FIG. 4 is a side perspective view of the foldable sign showing the frame from the side and all of the parts.

Posts 11A-11D are the main posts of the frame. These posts 11A-11D are thin elongated pieces with several holes placed in predetermined places to allow for the pieces to be held in a particular configuration. Posts 11A-11D will also be held in place by hinges on the top caps 16 and 17.

The posts 11A-11D move in and out and from side to side. The posts 11A-11D can be made of several types of materials including but not limited to steel, aluminum and plastic. In the preferred embodiment the material is aluminum.

Cross members 27A-27D are four separate pieces where two pieces each are attached in the middle by a pivot point. Cross members 27A-27D are elongated pieces connected in the middle by a pivot point. They form an "X" at 18 and 19 when opened. These crossed sections have an end with a hole and are fixed in place on one end 28A-28D. The other end is free to move along one a predetermined post 29A-29D.

Cross members 27A-27D are free to move on its pivot point up and down. It also moves inward and outward on that point.

The side locking arm 36A are two pieces which are mounted on opposite posts to either open or close the sign inward or outward. The side locking arm 36A is used to lock and secure a sign.

The locking arm 36A is an elongated member which is fixed at one end, to a predetermined position. The other end moves along a predetermined post with the use of a hinge. The locking arm 36A moves up and down along the posts 11A.

Sliding hinges 52A-52D allow the sign to be held in place at a particular point. The sliding hinges 52A-52D allow the posts, cross sections, locking arm to be connected at a point on the A frame. Sliding hinges 52A-52D allow the structure to be connected and other parts to move in a predetermined direction for a specific functionality.

The sign holding posts 63A and 63B are elongated, cylindrical posts attached to the frame posts 11A and 11B in order to hold the display sign 70. The sign posts 63A and 63B are attached to the frame posts 11A and 11B and hold the display sign 70 in place. The sign posts 11A and 11B can either be free moving and removable or fixed on place.

There are connections of main elements 11A-11D and cross elements 27A-27D sub of folding sign 10. The connections are with pivot pins, fasteners and hinges.

The folding sign 10 is designed to be able to close and open. It closes horizontally and diagonally to form the bottom end. The foldable sign 10 functions as an "A" frame floor sign. It closes just like a typical a frame, but the cross members allows it to close inward as well, unlike any other "A" frame floor sign.

Figure 5:
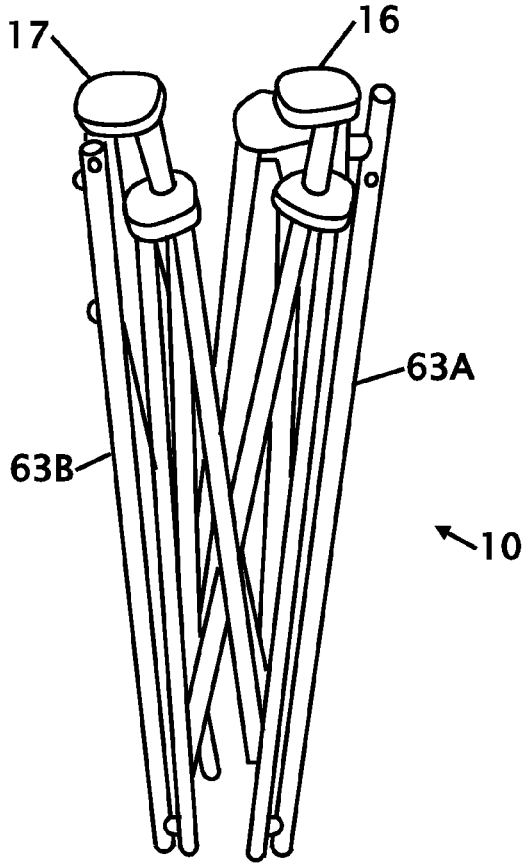
FIG. 5 is a front view of the foldable sign shown in a closed position.

FIG. 5 is a front view of the foldable sign 10 shown in a closed position. This view shows the top caps 16 and 17 with the elongated members in a collapsed configuration. In this closed orientation, the foldable sign 10 forms a dense package that can be placed in a bag for transportation. The sign 70 (not shown in this figure) can be wrapped around the collapsed frame.

Figure 6:
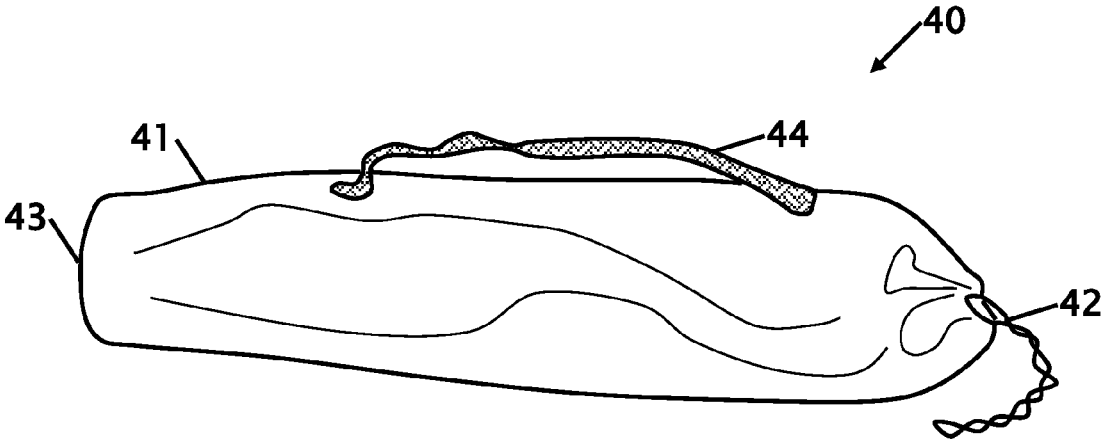
FIG. 6 is a side view of the foldable sign shown in a closed view inside of a carrying bag.

FIG. 6 is a side view of the foldable sign shown in a closed view inside of a carrying bag 40. The elongated bag 41 which allows the sign to be stored within the bag 40. The bag 40 has an opening 42 on one side with a locking mechanism at the same end. The locking mechanism is shows as a flexible cord 42 that passes through a closed seam along the top of the bag 40. The opposing end of the bag 40 has a closed end 43 that prevents the foldable sign from falling through the bag 40. The bag 40 is shown with a flexible strap 44 that allows a person to carry one or more of the foldable signed over a shoulder for transportation.

Thus, specific embodiments of a foldable sign have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A foldable sign comprising:

four elongated leg members formed as two pairs of hinged sides;

said two pairs of hinged sides being hinged at a first end at a top side on each pair of hinged sides;

said two pairs of hinged sides having free ends at a distal end from said hinged first ends;

four cross members forming two pairs of cross members connected at a mid-point of said cross members;

a lower end of each of said four elongated leg members having a pivot location at a first end of said four cross members wherein each of four elongated leg members has a separate cross member pivotally connected to said elongated leg;

a second distal end of each of said four cross members connected to a sliding pivot that slides on a separate one of said four elongated leg members, and two sign holding posts securable to each of said two pairs of hinged sides to secure a sign.

2. The foldable sign according to claim 1 wherein said elongated leg members are tubular.

3. The foldable sign according to claim 1 wherein said elongated leg members are made from a material selected from a group consisting or aluminum, steel or plastic.

4. The foldable sign according to claim 1 that further includes a locking arm.

5. The foldable sign according to claim 4 wherein said locking arm connects to said hinged sides at a location distal to said hinged side of said elongated leg members.

6. The foldable sign according to claim 5 wherein said locking arm locks said foldable sign in an open configuration.

7. The foldable sign according to claim 4 wherein said locking arm connects to two of said four cross members.

8. The foldable sign according to claim 7 wherein said locking arm locks said foldable sign in an open configuration.

9. The foldable sign according to claim 1 wherein said cross members are tubular.

10. The foldable sign according to claim 1 wherein said cross members are made from a material selected from a group consisting or aluminum, steel or plastic.

11. The foldable sign according to claim 1 wherein said sign is changeable.

12. The foldable sign according to claim 4 wherein said foldable sign forms an "A" frame.

13. The foldable sign according to claim 12 wherein each of said sliding pivots slides along one of said four elongated leg members.

14. The foldable sign according to claim 13 wherein said sliding pivots pivot said cross members on said elongated leg members to bring said two pairs of hinged sides together.

15. The foldable sign according to claim 14 wherein each of said two pairs of hinged sides hinge together to bring connected elongated leg members to an essentially parallel relationship.

16. The foldable sign according to claim 4 wherein said locking arm is made from a material selected from a group consisting or aluminum, steel or plastic.

17. The foldable sign according to claim 15 wherein foldable sign fits within an elongated soft sided bag.

18. The foldable sign according to claim 1 that further includes a flexible bag.

19. The foldable sign according to claim 1 further includes a flexible sign.

20. The foldable sign according to claim 19 wherein said flexible sign is secured with said two sign holding posts.

* * * * *